United States Patent [19]

Frear et al.

[11] 4,386,816

[45] Jun. 7, 1983

[54] ELECTRICAL CONNECTOR INSERT ASSEMBLY

[75] Inventors: David L. Frear, Afton; David O. Gallusser, Oneonta, both of N.Y.

[73] Assignee: The Bendix Corporation, Southfield, Mich.

[21] Appl. No.: 279,144

[22] Filed: Jun. 30, 1981

[51] Int. Cl.[3] ..... H01R 13/42

[52] U.S. Cl. ..... 339/59 R

[58] Field of Search ..... 339/59 R, 59 M, 217 S

[56] References Cited

U.S. PATENT DOCUMENTS

| | | | |
|---|---|---|---|
| 3,158,424 | 11/1964 | Bowen . | |
| 3,165,369 | 1/1965 | Maston . | |
| 3,221,292 | 11/1965 | Swanson et al. . | |
| 3,824,681 | 7/1974 | Clark | 339/90 C |
| 3,845,452 | 10/1974 | Eifler | 339/59 R |
| 4,082,398 | 4/1978 | Bourdon et al. | 339/217 S |

*Primary Examiner*—Mark Rosenbaum

*Attorney, Agent, or Firm*—Raymond J. Eifler

[57] ABSTRACT

The invention is an electrical connector insert assembly for retaining contacts in electrical connector of the type having front or rear releasable and rear removable contacts. The insert assembly that retains the contacts includes inserts (10) and (20) each having a plurality of passages (11, 21) having a respective contact (50) mounted therein and is characterized by a first and second plurality of resiliently and radially deflectable contact retention members (15, 25) arranged in face to face relationship in each of the passages (11, 21) the retention members (15, 25) having facing shoulders (16, 26) that retain the contact (50) by engaging the shoulders (52) and (53) of the enlarged portion (51) of the contact 50. Each of the contact retention members (15) include a free end portion (27, 17) with the free end portion (27) of one of the deflectable members (25) overlapping the free end portion (17) of the other deflectable member (15) so that when an appropriate tool is inserted into the passage (11) in one of the inserts (10) and the overlapped members are deflected radially outwardly, the overlapping members (27) also deflect radially outwardly to disengage its shoulder (26) from the shoulder (53) of the contact (50) to release the contact (50) for removal from the passage (21) in the other insert (20).

6 Claims, 6 Drawing Figures

FIG. 3
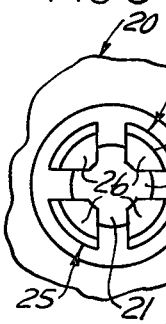
FIG. 1
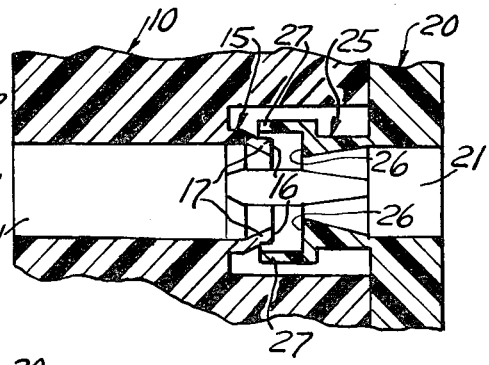
FIG. 2
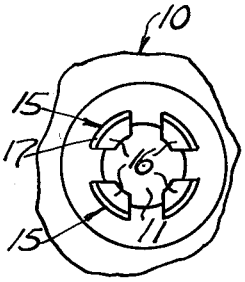
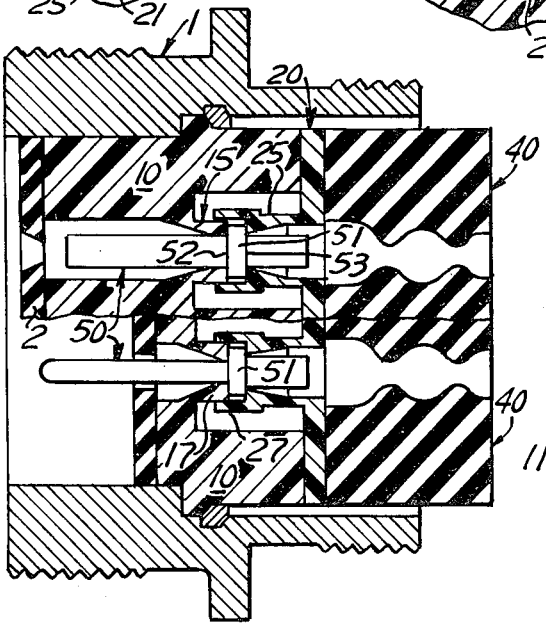
FIG. 4
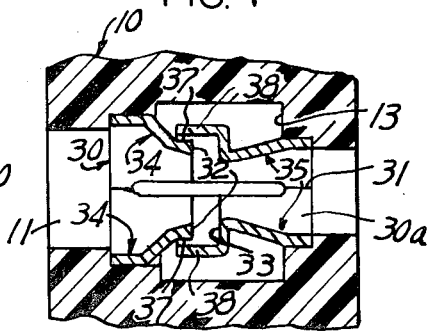
FIG. 5
FIG. 6
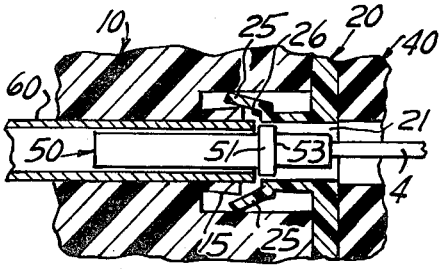

ELECTRICAL CONNECTOR INSERT ASSEMBLY

This invention relates to electrical connectors having front and rear releasable and rear removable contacts and more particularly to the contact retaining mechanism within the connector.

Electrical connectors generally include a plug and a receptacle, each of which has an insert of dielectric material provided with multiple openings within which electrical contacts are releasably retained. Examples of electrical connectors that have rear releasable and rear removable contacts may be found in U.S. Pat. Nos. 3,165,369 issued Jan. 12, 1965 and entitled, "Retention System for Electrical Contacts"; 3,158,424 issued Nov. 24, 1964 and entitled, "Contact Mounting"; and 3,824,681 issued July 23, 1974 and entitled, "Method of Providing a Coupling for Electrical Connectors and the Like". Connectors of this type allow contacts to be removed from the rear of a connector while it is still connected to another connector. An example of another type of electrical connector that has front releasable and front removable contacts as well as rear releasable and rear removable contacts may be found in U.S. Pat. No. 4,082,398 issued Apr. 4, 1978 and entitled, "Electrical Connector with Front and Rear Insertable and Removable Contacts". Finally, an example of an electrical connector of the type having front releasable and rear removable contacts may be found in U.S. Pat. No. 3,221,292 issued Nov. 30, 1960 and entitled "Electrical Connector". This last type of connector makes it easier to identify the contact to be removed since identification of the contact is located in the front face of the connector.

None of the foregoing connectors provide a connector that permits front or rear release of a contact that can be removed from the rear of the connector.

DISCLOSURE OF THE INVENTION

This invention provides an electrical connector having front or rear releasable and rear removable contacts.

The invention is an electrical connector of the type having a housing, a plurality of contacts, and means for mounting the contacts in said housing characterized by an insert having a plurality of passages that contain a first and second plurality of opposing resiliently and radially deflectable members that captivate an enlarged middle portion of the contact, the free end portions of one of the plurality of deflectable members overlapping respective free end portions of the other plurality of deflectable members so that radial outward deflection of the overlapped members also deflects the overlapping members radially outwardly to release a respective contact for removal from the insert.

One advantage of this invention is that it provides the option of releasing a contact from either the front or the rear of a connector depending on the circumstances involved with removing the contact from the rear of the connector.

Another advantage of the invention is that it provides a connector that combines the advantages of a front release and rear release connector into one connector having rear removable contacts.

DETAILED DESCRIPTION OF THE INVENTION

FIG. 1 illustrates a contact retaining insert assembly incorporating the principles of this invention.

FIG. 2 illustrates a rear end view of the forward insert.

FIG. 3 illustrates a front end view of the rear insert.

FIG. 4 illustrates an alternate embodiment of the invention.

FIG. 5 illustrates an electrical connector assembly incorporating the principles of this invention.

FIG. 6 illustrates a partial view of an electrical connector assembly illustrating how a contact is released for removal from the contact retaining insert assembly.

Referring now to the drawing, FIG. 1 illustrates an insert assembly comprised of a forward insert 10 and a rear insert 20. The forward insert 10 includes a passage 11 and a plurality of radially and resiliently deflectable contact retaining members 15. The contact retaining member 15 includes a free end portion 17 that includes a rearwardly facing shoulder 16. The rear insert 20 includes a passage 21 aligned with the passage 11 in the forward insert and a plurality of radially and resiliently deflectable members 25. The deflectable members 25 include a free end portion 27, which overlaps the free end portion 17 of the forward insert 10, and a forwardly facing shoulder 26.

FIG. 2 is a partial view of the rear face of the forward insert 10. Preferably four deflectable members 15 are arranged symmetrically around one end of the passage 11 in the forward insert 10.

FIG. 3 is a view of the front face of the rear insert 20 and illustrates that there are preferably four deflectable members 25 arranged symmetrically around one end of the passage 21 in the rear insert 20.

FIG. 4 is an alternate embodiment of the invention wherein the radially deflectable members 34 and 35 are formed from metal bushings 30 and **30*a* which are inserted into a cavity or channel 13 in the insert 10. In this embodiment of the invention the deflectable members are stamped and formed (rolled into a bushing) from a flat piece of metal stock such as beryllium copper. The seam 31 allows the bushing 30 to be compressed to a smaller diameter than the passage 11 so that the bushing 30 may be inserted into the channel 13 in the insert 10 where it expands to lock the bushing into the channel 13. The deflectable members 34, 35 include shoulders 32, 33, facing each other, that are adapted to captivate the enlarged portion of a contact (not shown). The free end portion 38 of the first plurality of deflectable members 35 overlapping the free end portion 37 of the second plurality of deflectable members 34**.

FIG. 5 illustrates an electrical connector assembly incorporating the principles of this invention. The electrical connector assembly generally includes: a shell 1, having mounted therein; a forward interfacial seal 2; a rear moisture sealing grommet 40; a plurality of electrical contacts 50; and a first and second insert 10 and 20 for retaining the contacts 50. As shown in detail on FIG. 1 the forward insert 10 and the rear insert 20 both include a plurality of deflectable members 15 and 25 respectively that captivate the enlarged portion 51 of the contact 50 by engaging forwardly facing shoulder 52 and rearwardly facing shoulder 53 with respective shoulders (16 and 26, FIG. 1). Both a socket type contact and a pin type contact may be releasably retained by the inserts 10 and 20 which include free end portions 27 of deflectable members 25 that overlap the free end portions 17 of deflectable members 15.

FIG. 6 illustrates how a contact 50 retained by the deflectable members 15 and 25 of the forward and rear inserts 10 and 20 are deflected radially outwardly by a tool 60 to allow the contact 50 to be removed from the rear of the passage 21 and the rear insert 20. Once an appropriate contact removal tool 60 is inserted into the forward insert 10 and has deflected the members 15 and 25 to free the enlarged portion 51 of the contact 50 the contact may be removed from the rear of the insert 20 by pulling on the wire 4 attached to the contact 50 or by pushing further on the tool 60 until the contact 50 is discharged from the rear of the passage 21 on the insert 20. Alternately, after the contact removal tool has been inserted into the forward insert 10 to deflect the members 15 and 25 to free the enlarged portion of the contact 50 the contact may be removed from the front of the insert 10 by a tool which grasps the contact 50 and pulls it forwardly from the insert 10. To release the contact 50 from the rear of the rear insert 20 an appropriate contact removal tool is inserted into passage 21 from the rear of the rear insert 20 until it deflects members 25 and disengaged forwardly facing shoulder 26 from the rearwardly facing shoulder 53 of the contact 50. Once the shoulders 26, 53 are disengaged, pulling on the wire 4 attached to the contact 50 will remove the contact 50 from the rear of the rear insert 20.

While a preferred embodiment of the invention has been disclosed it will be apparent to those skilled in the art that changes may be made to the invention as set forth in the appended claims and in some instances certain features of the invention may be used to advantage without corresponding use of other features. For instance, the deflectable members may be an integral part of the inserts 10 and 20 or may be bushings 30 and 30*a* that inserted into a channel 13 in one of the inserts. Further, although four retention members 15 and 25 are preferred, more or less members could be used. Accordingly, it is intended that the illustrative and descriptive materials herein be used to illustrate the principles of the invention and not to limit the scope thereof.

Having described the invention, what is claimed is:

1. In combination with an electrical connector having front releasable and rear removable contacts, said connector of the type having: a housing; a plurality of contacts, each having a rear portion, a forward mating portion, and an enlarged middle portion having a forwardly facing shoulder and a rearwardly facing shoulder; and means for releasably mounting said contact in said housing including a rear insert having a plurality of bores each having the rear portion of a respective contact therein, a plurality of resiliently and radially deflectable members extending from the forward portion of each of said bores, and a forward insert having a plurality of bores aligned with the bores in the rear insert and having a portion of the forward portion of a respective contact therein, the improvement wherein:

the forward insert includes a second plurality of resiliently and radially deflectable members extending from the rear portion of each said bores, each of said members having a free end portion that includes a rearwardly facing shoulder, said rearwardly facing shoulder of said forward insert engaging the forwardly facing shoulder of a respective contact, and a tapered surface, tapering radially outwardly away from the rearwardly facing shoulder of the forward insert, the tapered surfaces of said forward insert members adapted to receive a tool inserted into a respective bore from the front of the forward insert to deflect said members radially outwardly; and each of said deflectable members of said rear insert includes a free end portion and a forwardly facing shoulder located rearwardly of said free end portion, said forwardly facing shoulder of the rear insert engaging the rearwardly facing shoulder of a respective contact, the free end portion of said members of the rear insert overlapping a portion of the free end portion of said members of the front insert, the members of said rear insert adapted to be deflected radially outwardly by the members of the forward insert when the members of the forward insert are radially deflected, whereby when a tool is inserted into one of the bores in the front insert to engage and radially deflect the members of the first insert, the deflectable members of said second insert are also deflected thereby disengaging the forwardly facing shoulder of the second insert members from the rearwardly facing shoulder of the contact so that the contact may be removed from the rear of the bore in the rear insert.

2. The connector recited in claim 1 wherein the surface leading rearwardly away from the shoulders in each of the bores the rear insert is tapered radially outwardly, said surface adapted to engage a tool inserted into a bore from the rear of the rear insert which is adapted to expand the members at the end of a respective bore whereby a contact may be removed from the rear of the bore.

3. In combination with an electrical connector having removable contacts, said connector of the type having: a housing; a plurality of contacts, each contact having opposite end portions and an enlarged middle portion having oppositely facing shoulders; and means for releaseably mounting said contacts in said housing including: a first insert having a plurality of bores each having a portion of one end of a respective contact therein; and a second insert having a plurality of bores each having a portion of the opposite end of a respective contact therein and a plurality of resiliently and radially deflectable members extending from and around the end portion of each of said bores in said second insert in the direction of said first insert, each member including a shoulder that engages one of the shoulders of the contact located in a respective bore, the improvement wherein:

said first insert includes a second plurality of resiliently and radially deflectable members extending from and around the end of each of said bores in the direction of the second insert, each of said deflectable members including a free end portion that includes a shoulder that engages the opposite facing shoulder on the enlarged portion of the contact in a respective bore; and the free end portion of the deflectable members of said second insert overlapping a portion of the free end portion of the deflectable members of said first insert, the deflectable members of said first and second inserts arranged so that radial deflection of the members of said first insert radially deflects respective members of said second insert, whereby when a tool is inserted into one of the bores in the first insert to engage and radially deflect the deflectable members of the first insert, the deflectable members of said second insert are also deflected to disengage the shoulder on the deflectable members of said second insert from the shoulder on the enlarged portion of the contact thereby releasing the contact for removal from the bore in the second insert.

4. In combination with an electrical connector insert assembly of the type having first and second inserts of dielectric material each insert having a plurality of passages therethrough aligned with a respective passage of the other insert and adapted to receive respective electrical contacts having an enlarged section defining oppositely facing shoulders, said second insert having a first plurality of resiliently and radially deflectable contact retention members integral with said second insert and located around each of said passages, each of said members having a free end portion that includes a shoulder that is adapted to engage one of shoulders of a contact located in a respective passage, the improvement wherein the first and second inserts include:

a second plurality of resiliently and radially deflectable contact retention members integral with the first insert and located around each of said passages in said first insert and extending towards said second insert, each of said members having a free end that includes a shoulder adapted to engage the other shoulder of a contact located in a respective passage; and the free end portions of the deflectable members of one of said first insert and said second insert overlap the respective free end portions of the other of the deflectable members of said other insert, the free end portions arranged so that radially outward deflection of the overlapped members radially deflects the overlapping members of the other insert whereby, when a tool is inserted into one of the bores in the insert having the overlapped deflectable members and said overlapped members are deflected radially outwardly, the overlapping members are also deflected radially outwardly to disengage the shoulder of the overlapping members from the shoulder of the contact to release the contact for removal from the bore of the insert having the overlapping members.

5. In combination with an electrical connector having releasable and removable contacts, said connector of the type having: a housing; a plurality of contacts, each having a rear portion, a forward mating portion, and an enlarged middle portion having a forwardly facing shoulder and a rearwardly facing shoulder; and means for releasably mounting said contact in said housing including an insert of dielectric material having a plurality of bores therein, each bore having a respective contact therein and a plurality of resiliently and radially deflectable members extending forwardly in each of said bores, each of said deflectable members including a free end portion that includes a forwardly facing shoulder engaging the rearwardly facing shoulder of a respective contact, the improvement comprising:

a second plurality of resiliently and radially deflectable members extending rearwardly in each of said bores, each of said members having a free end portion that includes a rearwardly facing shoulder engaging the forwardly facing shoulder of a respective contact; and the free end portion of said first plurality of deflectable members overlapping the respective free end portions of the second plurality of deflectable members, the free end portions arranged so that radially outward deflection of the overlapped members radially deflects the overlapping members whereby, when a tool is inserted into one of the bores in the insert having the overlapped members and said overlapped members are deflected radially outwardly, the overlapping members are also deflected radially outwardly to disengage the shoulder of the overlapping members from the shoulder of the contact to release the contact for removal from the bore of the insert having the overlapping members.

6. The electrical connector recited in claim 5 including a tapered surface, tapering radially outwardly away from the shoulders of the other of said first and second plurality of deflectable members, said tapered surface adapted to receive a tool inserted into a respective bore to deflect said members radially outwardly.

* * * * *